US007252604B2

(12) United States Patent
Birss

(10) Patent No.: US 7,252,604 B2
(45) Date of Patent: Aug. 7, 2007

(54) TARGET APPARATUS FOR A SPORT GOAL

(76) Inventor: Arthur Birss, 17-9th Avenue, Whitehorse, Yukon (CA) Y1A 4H2

( * ) Notice: Subject to any disclaimer, the term of this patent is extended or adjusted under 35 U.S.C. 154(b) by 0 days.

(21) Appl. No.: 11/133,486

(22) Filed: May 20, 2005

(65) Prior Publication Data

US 2006/0033284 A1 Feb. 16, 2006

(30) Foreign Application Priority Data

Aug. 13, 2004 (CA) ..... 2477818

(51) Int. Cl.
*A63B 69/00* (2006.01)

(52) U.S. Cl. ..... 473/446; 273/400; 273/392

(58) Field of Classification Search ..... 273/398–402, 273/127 D, 392; 473/446, 454, 439, 422
See application file for complete search history.

(56) References Cited

U.S. PATENT DOCUMENTS

| | | | | |
|---|---|---|---|---|
| 3,197,208 | A | 7/1965 | Makar | |
| 3,944,223 | A | 3/1976 | Bromwell | |
| 4,842,283 | A | 6/1989 | LeBel et al. | |
| 5,238,243 | A | 8/1993 | Grispi | |
| D361,609 | S | 8/1995 | Bartlett | |
| 5,628,515 | A * | 5/1997 | Levy | 473/446 |
| 5,634,640 | A | 6/1997 | McCarrel | |
| 5,725,444 | A | 3/1998 | Heden | |
| 5,888,153 | A | 3/1999 | Masin | |
| 5,895,330 | A | 4/1999 | Reilly, Jr. | |
| 6,012,994 | A | 1/2000 | Beluse | |
| 6,695,724 | B2 | 2/2004 | Birss | |

FOREIGN PATENT DOCUMENTS

| | | |
|---|---|---|
| CA | 1057325 | 6/1979 |
| CA | 1070346 | 1/1980 |
| CA | 1202045 | 3/1986 |
| CA | 1206496 | 6/1986 |
| CA | 2168200 | 7/1997 |
| CA | 2141396 | 1/1999 |
| CA | 2216412 | 3/1999 |
| CA | 2152727 | 9/1999 |
| CA | 2244033 | 1/2000 |
| CA | 2418570 | 10/2003 |

* cited by examiner

*Primary Examiner*—Mark S. Graham
(74) *Attorney, Agent, or Firm*—Terrence N. Kuharchuk; Rodman & Rodman

(57) ABSTRACT

A target apparatus includes a bracket for attachment to a goal frame member such that a front of the bracket faces a forward direction perpendicular to a front goal plane of the goal, a back of the bracket faces a rearward direction and a defensive area side is adjacent a defensive area of the goal. A target defines a front target plane and a projectile receptacle. A target hinge connects the bracket and target such that the target is located adjacent the defensive area side, such that the target is rotatable relative to the bracket between a forward target position in which the front target plane is perpendicular to the forward direction and a deflected target position and such that the front target plane is rearward of the front of the bracket in the forward target position. A biasing mechanism urges the target to rotate toward the forward target position.

30 Claims, 7 Drawing Sheets

TARGET APPARATUS FOR A SPORT GOAL

FIELD OF INVENTION

The present invention relates to a target apparatus for use with a sport goal. The target apparatus is releasably attached with the sport goal and includes a target for receiving a sport projectile.

BACKGROUND OF INVENTION

In many sports, such as ice, field, floor and roller hockey, ringuette, lacrosse or soccer, in order to score in an opponent's net or goal, a player must be able to accurately direct or shoot a puck, ball or other sport projectile to a desired area or part of the goal. For instance, the corners of the sport goal often provide desirable areas for scoring opportunities.

Thus, it is desirable for a "shooting" player or "shooter" to practice a desired placement of the sport projectile in the sport goal in order to improve the player's accuracy. As a result, various target assemblies have been proposed which allow a shooting player to practice the placement of the sport projectile by aiming at the particular target area provided by the assembly.

For instance, Canadian Patent No. 1,057,325 issued Jun. 26, 1979 to Samaras describes a goal shield comprised of a frame and a sectional body. The sectional body is includes a plurality of interconnected panels which define a number of "through holes" therein. A net pocket is attached to the rear of the panel about the through holes. Thus, the shooter directs the sport projectile to the through holes in the panels of the goal shield. The placement of the through holes may not be readily adjusted as repositioning of the through holes requires rearrangement of the panels.

U.S. Pat. No. 3,944,223 issued Mar. 16, 1976 to Bromwell describes a goal which is formed of a rectangular frame that supports a canvas sheet fitted with peripheral openings. The canvas sheet is fastened by tension springs to the frame so that a ball or puck striking the canvas is rebounded away from the structure, while a ball or puck entering one of the peripheral openings is scored as a goal. The placement of the openings in the canvas sheet is not adjustable.

U.S. Pat. No. 5,725,444 issued Mar. 10, 1998 to Heden describes a device for training soccer players having a rectangular net body and a plurality of pockets, both made of a flexible net material. The rectangular net body defines a plurality of apertures. A pocket is attached to the perimeter of each aperture and sized to receive at least one soccer ball. The placement of the pockets in the net body is not adjustable.

Further, each of these apparatuses would interfere with or prohibit a goaltender or goalie from being properly positioned in the sport goal. Although practicing shooting of the sport projectile at a target in an "open net" without a goaltender positioned therein is beneficial, greater accuracy and benefits are provided by more closely simulating game conditions. Thus, it is desirable for the shooter to be able to practice the placement of the sport projectile by shooting at the target while a goaltender is in position in the sport goal, in order to more accurately reflect game play or game conditions.

While providing the shooter with conditions which more accurately reflect game conditions, the goaltender is also provided with an opportunity to practice blocking the sport projectile in these target areas. Thus, the goaltender's performance may also be improved through use of the target assembly.

Although various target assemblies have been proposed for use with the goaltender in position in the sport goal, these assemblies have not been found to be fully satisfactory for various reasons. For instance, the placement or positioning of the target assembly may be fixed or not readily adjustable such that the target assembly may not be easily or readily adjusted to alternate desirable target positions. Further, the placement or positioning of the target assembly may interfere with the goaltender's performance or movement in the sport goal. In addition, the configuration or structure of the target assembly may present a potential safety hazard, particularly in the event of contact by the shooter or the goaltender. Several examples of various conventional or known target assemblies are discussed below.

U.S. Pat. No. 5,634,640 issued Jun. 3, 1997 to McCarrel describes a sports target system adapted for connection with the frame of a sport goal. The target system includes at least one resiliently stretchable cord having hooks at each end thereof and at least one flaccidly flexible target, such as a cloth material, which hangs down from the cord. In operation, the player places one or more targets onto the stretchable cord by passing the stretchable cord through a loop of each of the targets. The hooks at each end of the stretchable cord are then engaged with the side frame of the sport goal.

U.S. Pat. No. 4,842,283 issued Jun. 27, 1989 to LeBel et. al. describes a target assembly which is mounted on the frame of a hockey goal. The target assembly is comprised of a support arm for fastening to the support of the hockey goal and a contact member to be hit by the sport projectile. When the surface of the contact member is hit by the projectile, the contact member is deflected from a selected target position. A spring is provided for returning the contact member to the selected target position for subsequent contact by a further projectile.

The spring used to return the contact member to the selected target position has a relatively small spring force and may not control the return movement of the contact member in a desirable manner. Further, when the contact member is deflected from the selected target position, the structure of the support arm, and its connection with the contact member, are such that they may present a safety hazard to a player which may abut against the target assembly.

Canadian Patent No. 2,152,727 issued Sep. 21, 1999 to Masin and U.S. Pat. No. 5,888,153 issued Mar. 30, 1999 to Masin describe a target assembly comprised of a clamping device for attachment to a goal post or crossbar and a target for a sport projectile. The target is comprised of a band of steel and a pocket connected to the perimeter of the target for catching the projectile. A spring is provided to connect the target with the clamping device and to absorb the impact of the projectile hitting the target.

Further, the spring is described as a heavy gauge spring made of steel or a metal alloy and strong enough to absorb the impact of a hockey puck travelling at speeds of up to 150 km/hr striking the target. Thus, the nature of the spring, the presence of the target in the goal and the manner in which the target is mounted with the goal may present a safety hazard to a player which may abut against the target assembly. This safety hazard is particularly of concern with smaller or inexperienced players due to the strength and nature of the spring which may not give or deflect sufficiently upon contact with the target.

Therefore, there remains a need in the industry for an improved target apparatus for use with a sport goal which can be used to improve the skills of both a player shooting a sport projectile at the sport goal and a goaltender positioned in the sport goal. Further, there remains a need for a target apparatus which may be used in a safe manner by shooters and goaltenders of all sizes and levels of experience.

SUMMARY OF INVENTION

The present invention relates to a target apparatus for use with a sport goal. More particularly, the target apparatus is releasably attached with the sport goal and includes a target for receiving a sport projectile. The target apparatus may be used for improving the skills of players in any sport in which the player, referred to as the shooter, must accurately direct a sport projectile into a net or goal. For instance, the present target apparatus is of particular use in sports such as ice, field, floor and roller hockey, ringuette, lacrosse and soccer, wherein a shooter must be able to accurately direct or shoot a sport projectile, such as a puck or ball, into an opponent's net or sport goal in order to score a point.

Further, the target apparatus may be used for improving the skills of a goaltender present in the net or sport goal and attempting to block the sport projectile from entering the net or sport goal. In this instance, the target apparatus may be attached with the sport goal to provide the target in an area of weakness for the goaltender such that the goaltender's ability to block the sport projectile shot or directed at these areas will be improved.

Thus, the target apparatus preferably permits the improvement of the skills of both the shooter directing the sport projectile at the sport goal and the goaltender positioned in the sport goal for blocking the sport projectile. Further, the target apparatus is preferably adapted or configured to permit its safe use on the sport goal during a full team practice, warm up drills, scrimmages and competitive skill testing games for both shooters and goaltenders. Thus, preferably, the target apparatus does not substantially interfere with normal or typical play or movement of the players, and particularly, does not substantially interfere with normal or typical play or movement of the goaltender within the sport goal.

However, in the event of contact with the target apparatus, the target apparatus is preferably adapted or configured to minimize any safety hazards for the players. Further, in the preferred embodiment, the target apparatus is relatively safe for use by minor and adult players alike and players of any size or level of skill or experience, as compared with conventional or known target assemblies.

In one aspect of the invention, the invention is comprised of a target apparatus for use with a sport goal, the sport goal comprising a plurality of frame members, the frame members defining a front goal plane and a defensive area within the front goal plane, the apparatus comprising:

(a) a mounting bracket comprising a front, an opposed back and a defensive area side, the mounting bracket being adapted to be releasably attached to one of the plurality of frame members such that the front of the mounting bracket faces a forward direction substantially perpendicular to the front goal plane, such that the back of the mounting bracket faces an opposed rearward direction and such that the defensive area side is adjacent to the defensive area;

(b) a target for a sport projectile, the target defining a front target plane and a projectile receptacle rearward of the front target plane;

(c) a target hinge connecting the mounting bracket and the target such that the target is located adjacent to the defensive area side of the mounting bracket, such that the target is rotatable relative to the mounting bracket between a forward target position for receiving the sport projectile in which the front target plane is substantially perpendicular to the forward direction of the mounting bracket and a deflected target position in which the front target plane is angularly displaced in the rearward direction from the forward target position, and such that the front target plane is rearward of the front of the mounting bracket when the target is in the forward target position; and (d) a biasing mechanism associated with the target hinge for urging the target to rotate relative to the mounting bracket toward the forward target position.

As indicated, the target apparatus is for use with any sport goal comprised of a plurality of frame members which define a front goal plane and a defensive area within the front goal plane. The defensive area is that area or space through which the shooter wishes to direct the sport projectile to score a goal, and thus is also that area or space which is sought to be defended or blocked by the goaltender. The sport projectile may be comprised of a ball, puck or any object desired to be directed within the defensive area of the sport goal to score a point. In the preferred embodiment, the target apparatus is for use with a sport goal comprised of a hockey goal, and the sport projectile is comprised of a hockey puck.

The mounting bracket may be comprised of any mounting structure or mounting mechanism able to be releasably attached in a relatively secure manner to one of the plurality of frame members of the sport goal such that movement of the mounting bracket relative to the frame member is significantly or substantially inhibited or prevented in order to secure or hold the mounting bracket in a desired orientation or position relative to the frame member. In particular, the mounting bracket is preferably adapted to be releasably attached to the desired frame member such that the front of the mounting bracket faces a forward direction substantially perpendicular to the front goal plane, such that the opposed back of the mounting bracket faces an opposed rearward direction and such that the defensive area side of the mounting bracket is adjacent to the defensive area of the sport goal.

The mounting bracket may be adapted to be releasably attached with any desired frame member, however, the mounting bracket is preferably adapted to be releasably attached with one of the frame members defining the front goal plane, such as one of two side frame members or a top frame member, which may be referred to as a crossbar, of the sport goal. More preferably, the mounting bracket is adapted to be releasably attached with one of the side frame members of the sport goal.

Further, the mounting bracket is adapted to be releasably attached with the frame member at any desired position or location along the length of the frame member or along the longitudinal axis of the frame member. The desired position or location for attachment of the mounting bracket will depend largely upon the desired location or position of the target in the sport goal, which will in turn, depend upon the desired practice area within the defensive area of the sport goal. The desired practice area is that portion of the defensive area in which the shooter desires or requires practice or skill improvement with respect to accurately directing the puck or in which the goaltender desires or requires practice or skill improvement with respect to blocking the puck.

It has been found that the areas of weakness requiring improvement for many shooters and goaltenders tend to be in the corners of the sport goal, as well as between the goaltender's legs, referred to as the "five hole." These areas tend to be the most "vulnerable" areas in a hockey goal, and also tend to demonstrate the highest scoring areas requiring protection by the goaltender. Accordingly, these areas tend to be the most common desired practice areas.

In order to place the target in the "five hole," the mounting bracket may require modification to permit its attachment to a central frame member comprising the sport goal or to permit its attachment to a lower or bottom frame member comprising the sport goal. Thus, the target is preferably positioned in one of the other four desired practice areas, being the "corners" of the sport goal—the upper left corner, the upper right corner, the lower left corner or the lower right corner. Although the target may be positioned in the upper corners of the sport goal by attaching the mounting bracket with the top frame, the mounting bracket is preferably attached with one of the side frame members along the length thereof at a location such that the target is positioned in the desired practice area.

In the preferred embodiment, and where desired, a plurality of the target apparatuses may be used such that a target may be positioned within each of a plurality of desired practice areas. For instance, a target may be positioned in each of the four corners of the sport goal.

Although the mounting bracket may be releasably attached in any manner, the mounting bracket preferably defines a mounting bracket bore for receiving the frame member, wherein the mounting bracket bore has a mounting bracket bore axis. The mounting bracket bore is preferably shaped or configured to closely receive the frame member therein such that the mounting bracket may be securely, snugly or firmly attached with the frame member to inhibit its movement relative thereto.

In addition, the outside or exterior of the mounting bracket is preferably rounded or radiused where possible such that no sharp edges, corners or ridges are unnecessarily provided which may be contacted by a player. In other words, the shape and configuration of the mounting bracket are further selected to reduce the likelihood of injury to a player in the event that contact occurs between the player and the mounting bracket.

Further, in the preferred embodiment, the apparatus is further comprised of a resilient material lining at least a portion of the mounting bracket bore, for inhibiting relative movement between the mounting bracket and the frame member. Any resilient material may be used to line the mounting bracket bore which is capable of inhibiting slippage or movement between the adjacent surfaces. However, in the preferred embodiment, the resilient material is comprised of a synthetic or natural rubber or a like material which lines at least a portion of the mounting bracket bore, and preferably lines substantially the entire mounting bracket bore. In addition to inhibiting relative movement between the mounting bracket and the frame member, the resilient material also acts to protect the frame member and prevent any damage or wear to the frame member caused by the mounting bracket.

Although the mounting bracket may have any structure or configuration compatible with its intended use and functions as described herein, the mounting bracket is preferably comprised of a first mounting bracket component, a second mounting bracket component, and a mounting bracket hinge for connecting the first mounting bracket component and the second mounting bracket component. More preferably, the first mounting bracket component is comprised of a first end and a second end, wherein the second mounting bracket component is comprised of a first end and a second end, wherein the mounting bracket hinge connects the first end of the first mounting bracket component with the first end of the second mounting bracket component, and wherein the mounting bracket is further comprised of a releasable fastener mechanism for releasably connecting the second end of the first mounting bracket component with the second end of the second mounting bracket component.

The releasable fastener mechanism may be comprised of any fastener or attachment structure or mechanism capable of, and suitable for, releasably connecting the second ends of the first and second mounting bracket components. Preferably, the releasable fastener mechanism is selected to reduce the likelihood of contact with the releasable fastener mechanism by the players and to reduce the likelihood of injury in the event that contact occurs.

Preferably, the releasable fastener mechanism is comprised of at least one threaded fastener, wherein the first mounting bracket component defines a hole adjacent the second end for accepting the threaded fastener and wherein the second mounting bracket component defines a hole adjacent the second end for accepting the threaded fastener. In addition, the releasable fastener mechanism is preferably further comprised of a wing nut for attachment to the threaded fastener. In the preferred embodiment, in order to facilitate a relatively secure attachment of the mounting bracket with the frame member, the releasable fastener mechanism may be comprised of a plurality of threaded fasteners and corresponding wing nuts. In the preferred embodiment, the releasable fastener mechanism is comprised of two threaded fasteners and two corresponding wing nuts. Thus, the first and second mounting brackets each define two holes therein for accepting the threaded fasteners.

As stated, the mounting bracket is preferably adapted to be releasably attached to the frame member such that the front of the mounting bracket faces a forward direction substantially perpendicular to the front goal plane, the back faces an opposed rearward direction and the defensive area side is adjacent to the defensive area of the sport goal. Further, in the preferred embodiment, the mounting bracket hinge is located at the front of the mounting bracket. In addition, the releasable fastener mechanism is preferably located at the back of the mounting bracket. Finally, the wing nut is preferably fastened with the threaded fastener such that the wing nut is located adjacent the defensive area side of the mounting bracket.

As well, in order to enhance the safety of the mounting bracket, particularly upon contact with a player, the target apparatus is preferably further comprised of a removable cushion pad for substantially surrounding the front of the mounting bracket. In particular, the removable cushion pad substantially surrounds the front or portion of the mounting bracket which faces in the forward direction towards an oncoming shooter or towards the goaltender during use of the target apparatus. Thus, the portion of the mounting bracket most likely to be impacted by a player is surrounded by the removable cushion pad.

The removable cushion pad may be comprised of any material or materials capable of providing the desired cushioning effect or padding for the mounting bracket. Further, the cushion pad is preferably comprised of a relatively durable, tear-resistant material. In addition, where the target apparatus is to be used outdoors or in potentially wet or moist conditions, the cushion pad is also preferably comprised of a water-resistant or water repellant material. In the preferred embodiment, the cushion pad is comprised of a vinyl covering with an inner felt padding.

The cushion pad may be removably attached with the mounting bracket in any secure manner and by any relatively secure fastening mechanism or fastener capable of maintaining the cushion pad on the mounting bracket during use of the target apparatus and upon contact therewith by a player. In the preferred embodiment, the removable cushion pad is removably attached with the mounting bracket by the releasable fastener mechanism comprising the mounting bracket.

In particular, one side of the cushion pad defines a pair of holes corresponding with the holes at the second ends of the first and second mounting bracket components. Each of the holes in the cushion pad receives the threaded fastener as it is passed through the corresponding holes in the mounting bracket components. Thus, attachment of the wing nut to the threaded fastener further secures one end of the cushion pad with the second ends of the first and second mounting bracket components. The other opposed end of the cushion pad includes an elastic retention cord which extends about the target hinge to secure the other opposed end of the cushion pad in position. Thus, the cushion pad is maintained across the front of the mounting bracket, while permitting the rotation of the target relative to the mounting bracket.

As stated, the target apparatus is further comprised of a target for the sport projectile. The target defines a front target plane and a projectile receptacle rearward of the front target plane. Thus, a sport projectile passing through the front target plane will be received in the projectile receptacle. Preferably, the projectile receptacle is configured to receive a plurality of sport projectiles therein. As well, the target preferably further comprises a closing mechanism for selectively closing the projectile receptacle to permit the sport projectiles to accumulate in the projectile receptacle and for selectively opening the projectile receptacle to permit the sport projectiles to pass through the projectile receptacle without accumulating in the projectile receptacle.

The projectile receptacle may be comprised of any material or materials capable of receiving the plurality of sport projectiles therein. In addition, the material is preferably a relatively flexible or non-rigid material capable of withstanding the impact of the sport projectile therein. In the preferred embodiment, the projectile receptacle is comprised of a net. Further, in the preferred embodiment, the net is of the same type as the netting used for the hockey goal.

More particularly, the front target plane is comprised of and defined by a relatively rigid target frame. The target frame may have any shape and configuration, but is preferably of a size and shape compatible with receiving the sport projectile and for improving the skill level of the players. In the preferred embodiment, the target frame is comprised of rounded steel bar which is formed into a square shape having rounded or radiused corners.

The projectile receptacle, and in particular the net, is attached to the target frame such that a sport projectile passing through the target frame enters the net. The net may be attached or affixed with the target frame in any secure manner. However, preferably, the attachment mechanism does not present a safety hazard to the players during use of the target apparatus. Thus, in the preferred embodiment, a corrugated steel round wire is attached, preferably by welding, to the portion of the target frame facing in the rearward direction when the target is in the forward target position. The net is then secured to the corrugated steel by a cord or rope material similar to that used for the net. Positioning of the cord or rope material on the rearward side of the target frame also lessens the likelihood of its being cut or damaged by a player or a sport projectile during use of the target apparatus.

Any type or manner of mechanism for closing the projectile receptacle may be used which is compatible with the projectile receptacle. Thus, in the preferred embodiment, any type or manner of closing mechanism may be used which is capable of selectively closing the net comprising the projectile receptacle. Preferably, the closing mechanism is comprised of a drawstring. Thus, when the drawstring is tightened, the projectile receptacle will be closed such that the sport projectiles will accumulate therein. Following a practice session, a player or goaltender will then be able to observe the areas in which the most or least sport projectiles have accumulated, thus providing guidance on areas in need of further practice. Alternately, if the drawstring is loosened, the projectile receptacle will be opened such that the sport projectiles will be allowed to pass through the projectile receptacle.

As stated, the target hinge connects the mounting bracket and the target in a desired orientation and such that the target is rotatable relative to the mounting bracket. More particularly, the target hinge connects the target with the mounting bracket such that the target is located adjacent to the defensive area side of the mounting bracket. Thus, when the mounting bracket is attached with the frame member of the sport goal, the target is located or positioned in the defensive area of the sport goal.

Further, the target hinge connects the target with the mounting bracket such that the target is rotatable relative to the mounting bracket between a forward target position and a deflected target position. As outlined above, the sport projectile is intended to pass through the target frame into the projectile receptacle. Depending upon the force of the contact of the sport projectile with the projectile receptacle or the target frame, the target may be caused to move towards the deflected target position. Further, the target will preferably be caused to move towards the deflected target position upon contact of a player with the target frame in order to avoid any potential injury to the player.

In the forward target position, the front target plane is preferably substantially perpendicular to the forward direction of the mounting bracket such that the target is positioned for receiving the sport projectile in the projectile receptacle. Thus, when the mounting bracket is attached with the frame member of the sport goal, the front target plane is substantially parallel with the front goal plane of the sport goal in the forward target position. In other words, the target apparatus is preferably configured such that the front target plane is substantially parallel to the front goal plane when the mounting bracket is attached to the frame member and the target is in the forward target position.

In the deflected target position, the front target plane is angularly displaced in the rearward direction from the forward target position. In other words, the target is deflected within the sport goal or towards the back of the sport goal away from, or rearward of, the front goal plane. As a result, in the deflected target position, the front target plane is not perpendicular to the forward direction of the mounting bracket and the front target plane is not parallel to the front goal plane when the mounting bracket is attached to the frame member.

Finally, the target hinge connects the target with the mounting bracket such that the front target plane is rearward of the front of the mounting bracket when the target is in the forward target position. This feature is provided primarily for safety reasons. In particular, as a result of this connection, when the mounting bracket is attached with the frame member of the sport goal, the front target plane is coincident with, or preferably rearward of, the front goal plane which is defined by the frame members of the sport goal. The apparatus is preferably configured such that the front target plane is rearward of the front goal plane when the mounting bracket is attached to the frame member and the target is in the forward target position. As a result, the target is positioned or located within the sport goal or towards the back of the sport goal away from, or rearward of, the front goal plane in both the forward target position and the deflected target position.

Further, the target hinge may connect the target with the mounting bracket such that the front target plane intersects with the mounting bracket bore when the target is in the forward target position. In this instance, when the mounting bracket is attached with the frame member of the sport goal, the front target plane preferably intersects with the frame member which is received within the mounting bracket bore. As well, the target hinge may connect the target with the mounting bracket such that the front target plane is substantially rearward of the mounting bracket bore when the target is in the forward target position. In this instance, when the mounting bracket is attached with the frame member of the sport goal, the front target plane is preferably substantially rearward of the frame member. In each of these configurations, the target is again positioned or located within the sport goal in both the forward target position and the deflected target position.

Accordingly, in all of these configurations with respect to the placement or positioning of the front target plane when the target is in the forward target position, the likelihood of accidental or incidental contact with the target by the shooter or goaltender during use of the target apparatus is reduced. Further, when the target is contacted by a player, resulting in rotation of the target towards the deflected target position, the target moves in a direction within the sport goal or rearward, again reducing any likelihood of injury as a result of contact with the target during this movement.

The target hinge may be connect the target with the mounting bracket in any manner and at any location on the mounting bracket compatible with, and suitable for, achieving the above noted criteria or functions of the target hinge. However, preferably, the target hinge has a target hinge axis and the target hinge axis is substantially parallel with the mounting bracket bore axis. Further, the target hinge preferably connects the target with the mounting bracket adjacent the back of the mounting bracket.

In addition, the apparatus is preferably further comprised of a stop mechanism for preventing the rotation of the target relative to the mounting bracket such that the front target plane is angularly displaced in the forward direction from the forward target position. In other words, the apparatus is preferably configured such that rotation of the target relative to the mounting bracket from the forward target position in the forward direction is substantially restrained or inhibited, particularly when the mounting bracket is attached to the frame member. When the mounting bracket is attached with the frame member, it is desirable for safety reasons to prevent or substantially restrain the deflection of the target out of the sport goal or forward of the front goal plane. As a result, the likelihood of accidental or incidental contact with the target by the shooter or goaltender during use of the target apparatus is further reduced.

The target apparatus is also comprised of the biasing mechanism associated with the target hinge for urging the target to rotate relative to the mounting bracket toward the forward target position. The biasing mechanism may be comprised of any mechanism or structure capable of biasing or urging the target toward the forward target position. Thus, in the event of any contact with the target, by a sport projectile or a player, the target will first be moved from the forward target position toward the deflected target position. Subsequently, the biasing mechanism will cause the target to be returned to the forward target position.

The biasing force of the biasing mechanism is selected such that the target is maintained in the forward target position, while permitting its movement toward the deflected target position upon contact with the target. Further, the biasing mechanism is selected to provide a biasing force which is compatible with, and suitable for, the size, skill and experience level of the particular players using the target apparatus at any given time. The biasing force will be selected to reduce, and preferably minimize, any likelihood of injury to a player upon contact with the target, while resisting deflection upon minimal or minor contact with the target, such as by the sport projectile, and readily returning the target to the forward target position in a controlled manner when deflected such that the target is maintained in a "ready" forward target position during the practice session. In this regard, a greater or higher biasing force may be desirable for larger/older players or those having a higher skill or experience level, while a lesser or lower biasing force may be desirable for smaller/younger players or those having a lower skill or experience level. Preferably, the biasing mechanism is comprised of a spring. Thus, the spring is selected to provides a desired spring force, as discussed above.

In the preferred embodiment, the biasing mechanism is comprised of a biasing adjustment mechanism for adjusting a biasing force provided by the biasing mechanism. Thus, the biasing force may be adjusted to a biasing force which is suitable for the intended use of the target apparatus at any given time. Accordingly, as outlined above, the biasing adjustment mechanism may be used to adjust the biasing force such that it is compatible with, and suitable for, the size, skill and experience level of the particular players intending to use the target apparatus. In the preferred embodiment in which the biasing mechanism is comprised of a spring, the biasing adjustment mechanism permits the adjustment of the spring force provided by the spring. The biasing adjustment mechanism may be comprised of any mechanism or structure suitable for, or capable of, adjusting the biasing force, and preferably the spring force, to a desired level. However, preferably, the biasing adjustment mechanism is comprised of a spring tightening mechanism.

In the preferred embodiment, the target hinge is comprised of the biasing mechanism and the biasing adjustment mechanism. In particular, the target hinge is comprised of an adjustable spring hinge. Any conventional or known adjustable spring hinge may be used, which may also be referred to as an adjustable "self-closing" spring hinge or an adjustable spring loaded hinge. Preferably, the adjustable spring hinge is comprised of an Allen screw which acts upon the spring and the spring force is adjusted through the use of a compatible Allen wrench or key for turning the Allen screw in a desired direction to either "tighten" or "loosen" the Allen screw acting upon the spring. In the preferred embodiment, the target hinge is comprised of a STANLEY™ spring hinge having an adjustable tension or spring force. The target hinge is preferably welded to each of the mounting bracket and the target, particularly the target frame.

SUMMARY OF DRAWINGS

Embodiments of the invention will now be described with reference to the accompanying drawings, in which.

DETAILED DESCRIPTION

Figure 1:
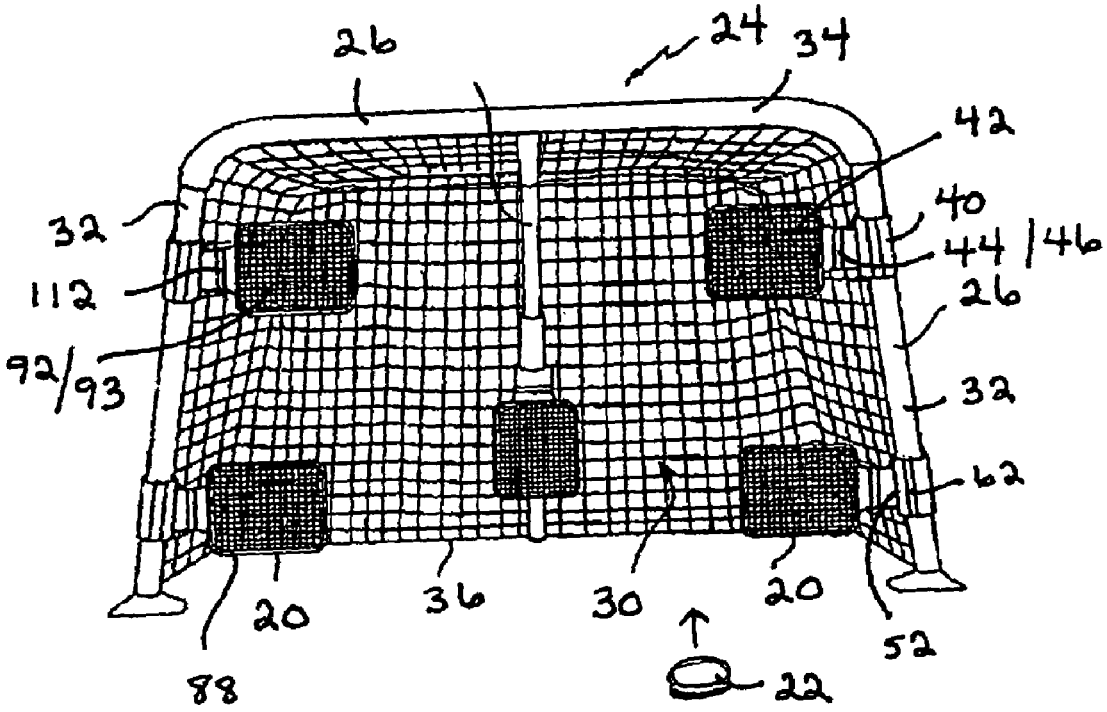
FIG. 1 is a front pictorial view of a sport goal having a preferred embodiment of a target apparatus of the within invention attached thereto.
Figure 2:
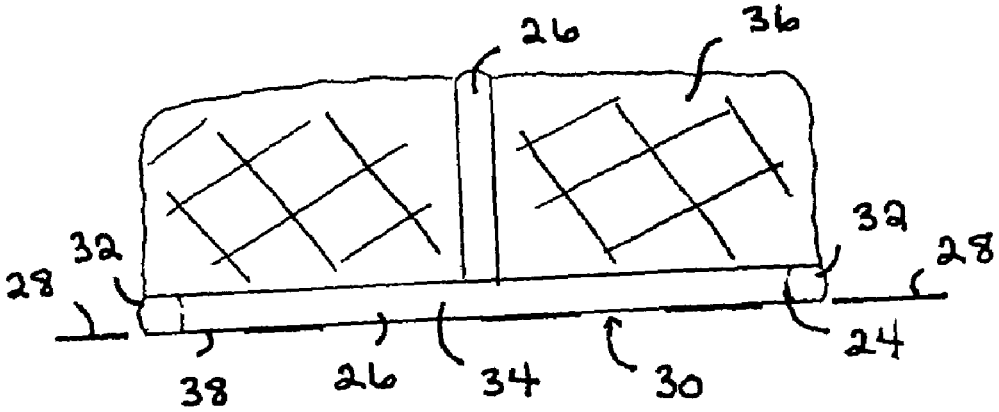
FIG. 2 is a top view of the sport goal shown in FIG. 1.

Referring to FIGS. 1-2, the present invention relates to a target apparatus (20) for a sport projectile (22) for use with a sport goal (24). In the preferred embodiment of the target apparatus (20), the sport goal (24) is for use in playing ice hockey, and may be referred to herein as a hockey goal. Thus, the sport projectile (22) is a hockey puck. The target apparatus (20) is provided for improving the accuracy of a shooter directing the hockey puck (22) into the hockey goal (24) to score. Further, the target apparatus (20) is provided for improving the skills of a goaltender blocking the hockey goal (24) to prevent the passage of the puck (22) therein.

The sport goal (24), being a hockey goal in the preferred embodiment, is comprised of a plurality of relatively rigid frame members (26) which define a front goal plane (28) and a defensive area (30) within the front goal plane (28). More particularly, the plurality of frame members (26) is comprised of a pair of opposed side frame members (32) and a top frame member (34) or crossbar extending therebetween. A standard hockey goal net (36) is connected with the side and top frame members (32, 34) in a conventional manner. The sport goal (24) may further include any number of additional frame members (26), as required or desired to properly support the sport goal (24) or the net (36), such as one or more central frame members or lower or back frame members.

In addition, the pair of opposed side frame members (32) and the top frame member (34) together define the front goal plane (28) and thus the defensive area (30) therein. More particularly, the most forward portion or surface of each of the pair of opposed side frame members (32) and the top frame member (34) comprises a front (38) of the sport goal (24), wherein the front (38) of the sport goal (24) defines the front goal plane (28). The front (38) of the sport goal (24) faces in a forward direction away from the net (36) of the sport goal (24).

Further, the defensive area (30) is that area or space defined by the front goal plane (28), and particularly the front (38) of the sport goal (24), through which the shooter wishes to direct the sport projectile (22) to score a goal. Thus, the defensive area (30) of the sport goal (24) is also that area or space which is sought to be defended or blocked by the goaltender.

Referring to FIGS. 3-9, the target apparatus (20) is comprised of a mounting bracket (40), a target (42), a target hinge (44) connecting the mounting bracket (40) and the target (42) and a biasing mechanism (46) associated with the target hinge (44).

The mounting bracket (40) is comprised of a front (48) and an opposed back (50). Further, the mounting bracket (40) is further comprised of a defensive area side (52) which extends along one of the sides of the mounting bracket (40) between the front (48) and the back (50). As well, the mounting bracket (40) preferably defines a mounting bracket bore (54) having a mounting bracket bore axis (56). The mounting bracket bore (54) is defined as, or by, that inner portion or interior surface of the mounting bracket (40) which is shaped or configured to receive a desired frame member (26) therein. In the preferred embodiment, the mounting bracket bore (54) is defined by the inner portion on interior surface of the mounting bracket (40) which engages the frame member (26) of the sport goal (24) therein.

In the preferred embodiment, as shown in FIGS. 3-6, the mounting bracket (40) is comprised of a first mounting bracket component (58) and a second mounting bracket component (60). Preferably, the first and second mounting bracket components (58, 60) are substantially similar in shape or configuration such that each of the first and second mounting bracket components (58, 60) generally forms or comprises one-half of the complete mounting bracket (40). The first and second mounting bracket components (58, 60) may be capable of being completely separated from each other in order to mount the mounting bracket (40) on a frame member (26), as discussed below.

However, preferably, the mounting bracket (40) is comprised of a mounting bracket hinge (62) for connecting the first mounting bracket component (58) and the second mounting bracket component (60). In the preferred embodiment, each of the first mounting bracket component (58) and the second mounting bracket component (60) are comprised of 3⁄16 inch flat steel plate with the mounting bracket hinge (62) connected therebetween. In the preferred embodiment, the mounting bracket hinge (62) is located at the front (48) of the mounting bracket (40).

More particularly, the first mounting bracket component (58) is comprised of a first end (64) and an opposed second end (66) and the second mounting bracket component (60) is comprised of a first end (68) and an opposed second end (70). The mounting bracket hinge (62) is provided for connecting the first ends (64, 68) of the first and second mounting bracket components (58, 60). Accordingly, the mounting bracket (40) may be "opened" by moving the second ends (66, 70) apart or away from each other, similar to a clam shell, to permit the attachment of the mounting bracket (40) on the frame member (26). Conversely, the mounting bracket (40) may be "closed" for attachment of the mounting bracket (40) on the frame member (26) by moving the second ends (66, 70) together or toward each other.

The mounting bracket (40) is further comprised of a releasable fastener mechanism (72) for maintaining the mounting bracket (40) in the closed position. In the preferred embodiment, as stated, the mounting bracket hinge (62) is located at the front (48) of the mounting bracket (40). In addition, the releasable fastener mechanism (72) is located at the back (50) of the mounting bracket (40). More particularly, the releasable fastener mechanism (72) releasably connects the second end (66) of the first mounting bracket component (58) with the second end (70) of the second mounting bracket component (60).

Preferably, the releasable fastener mechanism (72) is comprised of at least one and preferably two threaded fasteners (74). In the preferred embodiment, each threaded fastener (74) is comprised of a stove bolt. Further, the releasable fastener mechanism (72) is preferably comprised of a compatible wing nut (76) for attachment to an end of each stove bolt (74) to hold the stove bolt in position. In the preferred embodiment, each wing nut (76) is comprised of a relatively large, round edged, four finger wing nut, preferably comprised of plastic.

Further, in order to utilize the preferred releasable fastener mechanism (72), the first mounting bracket component (58) defines a hole (78) for receiving each threaded fastener (74). Thus, in the preferred embodiment, the first mounting bracket component (58) defines two holes (78) therein. Further, the second mounting bracket component (60) defines a hole (80) for receiving each threaded fastener (74) which corresponds with the hole (78) in the first mounting bracket component (58). Thus, in the preferred embodiment, the second mounting bracket component (60) also defines two holes (80) therein. Further, each of the holes (78, 80) is preferably located or positioned adjacent the second ends (66, 70) such that the second ends (66, 70) of the first and second mounting bracket components (58, 60) can be held together in the closed position. The holes (78, 80) are sized for receiving the threaded fasteners or stove bolts (74) therein. In the preferred embodiment, the holes (78, 80) are about ⅜ inches in diameter. Further, the stove bolts (74) are about ⅜ inches in diameter and about 2 inches in length.

The mounting bracket bore (54) is preferably shaped or configured to closely receive the desired frame member (26) therein in order that the mounting bracket (40) is securely, snugly or firmly attached with the frame member (26) such that relative movement of the mounting bracket (40) and the frame member (26) is inhibited, and preferably prevented. In the preferred embodiment, the frame members (26) of the hockey goal (24) are cylindrical or substantially circular on cross-section. Thus, the mounting bracket bore (54) is preferably shaped or configured to be closely engaged with at least a portion of an outer surface or exterior of the cylindrical frame member (26) when the mounting bracket (40) is attached with the frame member (26). The entire or complete outer surface or exterior of the cylindrical frame member (26) need not be engaged by the mounting bracket bore (54) so long as the extent of the engagement is sufficient to substantially inhibit relative movement of the mounting bracket (40) and the frame member (26).

Further, in the preferred embodiment, the apparatus (20) is further comprised of a resilient material (82) lining at least a portion of the mounting bracket bore (54) in order to further inhibit relative movement between the mounting bracket (40) and the frame member (26) or lessen any slippage or movement between the adjacent surfaces. In addition, the resilient material (82) is provided to protect the frame member (26) and prevent or lessen any damage or wear to the frame member (26) caused by the mounting bracket (40). In the preferred embodiment, the resilient material (82) is comprised of a synthetic or natural rubber or a like material. In particular, one or more rubber strips are affixed in any manner, such as by gluing, within the mounting bracket bore (54). Further, in the preferred embodiment, the resilient material (82) lines at least that portion of the mounting bracket bore (54) which will be engaged or in contact with the frame member (26) when the mounting bracket (40) is mounted thereon.

As well, an outside surface (84) or exterior of the mounting bracket (40), and particularly the outside surface or exterior of each of the first and second mounting bracket components (58, 60), is preferably shaped to minimize the risk of injury to a player in the event that the player contacts the mounting bracket (40) during use of the target apparatus (20). Thus, in the preferred embodiment, the mounting bracket (40) is rounded or curved at any edges thereof such that no sharp edges, corners or ridges are provided which may injure the player.

Further, the back (50) of the mounting bracket (40) is preferably comprised of a "dove-tailed" portion (86) as shown in FIGS. 4-6 and 9. The dove-tailed portion (86) of the mounting bracket (40) extends rearward from the mounting bracket bore (54) for connection of the releasable fastener mechanism (72). Specifically, the dove-tailed portion (86) defines the holes (78, 80) for receipt of the threaded fasteners (74) therein. As a result, the releasable fastener mechanism (72) may be positioned substantially behind or rearward of the mounting bracket (40) or such that the releasable fastener mechanism (72) does not substantially protrude beyond the extent of the mounting bracket (40) when viewed from the front (48). In other words, when viewed from the front (48) of the mounting bracket (40), the threaded fasteners (74) and wing nuts (76) are "tucked" behind the mounting bracket (40) such that they are not readily observable. As a result, any potential contact with the releasable fastener mechanism (72) during use of the target apparatus (20) is reduced.

In the preferred embodiment, the mounting bracket (40) is releasably attached to a desired frame member (26) of the sport goal (24) such that the front (48) of the mounting bracket (40) faces a forward direction substantially perpendicular to the front goal plane (28), the back (50) faces an opposed rearward direction and the defensive area side (52) is adjacent to the defensive area (30) of the sport goal (24). Further, the wing nuts (76) are fastened with the threaded fasteners (74) such that the wing nuts (76) are located adjacent the defensive area side (52) of the mounting bracket (40). This manner of attachment again reduces any likelihood of injury to a player upon contact with the mounting bracket (40), and further reduces the likelihood of contact of the player with the releasable fastener mechanism (72).

Preferably, the mounting bracket (40) is releasably attached with one of the frame members (26) of the sport goal (24) defining the front goal plane (28). More particularly, in the preferred embodiment, the mounting bracket (40) is releasably attached with either of the two side frame members (32). The mounting bracket (40) is releasably attached such that it may be moved to any location along the length of the desired side frame member (32) depending upon the desired practice area within the defensive area (30) of the sport goal (24). The desired practice area is that portion of the defensive area (30) in which the shooter desires or requires practice or skill improvement with respect to accurately directing the sport projectile (22) or in which the goaltender desires or requires practice or skill improvement with respect to blocking the sport projectile (22). In the preferred embodiment, a plurality of the target apparatuses (20) are positioned within a plurality of desired practice areas. More particularly, as shown in FIG. 1, a target apparatus (20) is positioned in each of the four corners of the sport goal (24), being an upper left corner, an upper right corner, a lower left corner and a lower right corner of the defensive area (30).

As indicated above, the target apparatus (20) further includes the target (42) for the sport projectile (22). In the preferred embodiment, the target (42) is comprised of a target frame (88) which defines a front target plane (90). More particularly, a most forward portion or forward facing surface (91) of the target frame (88) defines the front target plane (90). The target frame (88) further provides or defines that area or space of the target (42) through which the shooter desires to direct the sport projectile (22). Thus, the target frame (88) is shaped or configured and sized for passage of the sport projectile (22) therethrough and to improve the skill level of the players. Preferably, the target frame (88) is comprised of a rounded steel bar which is formed into a substantially square shape having relatively rounded or radiused corners. More particularly, in the preferred embodiment, the target frame (88) is comprised of a rounded steel bar having a diameter of ⅜ inches which is formed into a square having sides of about 12 inches in length and rounded or radiused corners.

Further, the target (42) is comprised of a projectile receptacle (92) rearward of the front target plane (90). More particularly, the projectile receptacle (92) is attached with, and substantially rearward of, the target frame (88). Thus, a sport projectile (22) passing through the target frame (88) will be received in the projectile receptacle (92). Preferably, the projectile receptacle (92) is configured to receive a plurality of sport projectiles (22) therein. Further, the projectile receptacle (92) is preferably comprised of a net (93) or netting material such as that typically or conventionally used for the net of a hockey goal.

The net (93) comprising the projectile receptacle (92) is attached or affixed about the target frame (88) in a manner permitting the sport projectile (22) to pass therein. In the preferred embodiment, a corrugated steel round wire (94) is attached, preferably by welding, to the target frame (88). Preferably, the corrugated steel round wire (94) is welded with the most rearward portion or rearward facing surface (96) of the target frame (88). This positioning lessens the likelihood of a player contacting the corrugated steel round wire (94) during use of the target apparatus (20). The net (93) comprising the projectile receptacle (92) is then affixed to the corrugated steel round wire (94) in any secure manner, such as by using a cord or rope material to fasten the net (93) to the corrugated steel round wire (94). In the preferred embodiment, ⅛ inch diameter nylon cord is used. As a result of the positioning of the corrugated steel round wire (94), the cord or rope material fastening the net (93) is positioned adjacent the rearward surface (96) of the target frame (88). As result, the likelihood of the cord being cut or damaged by a player or a sport projectile (22) during use of the target apparatus (20) is reduced.

Figure 7:
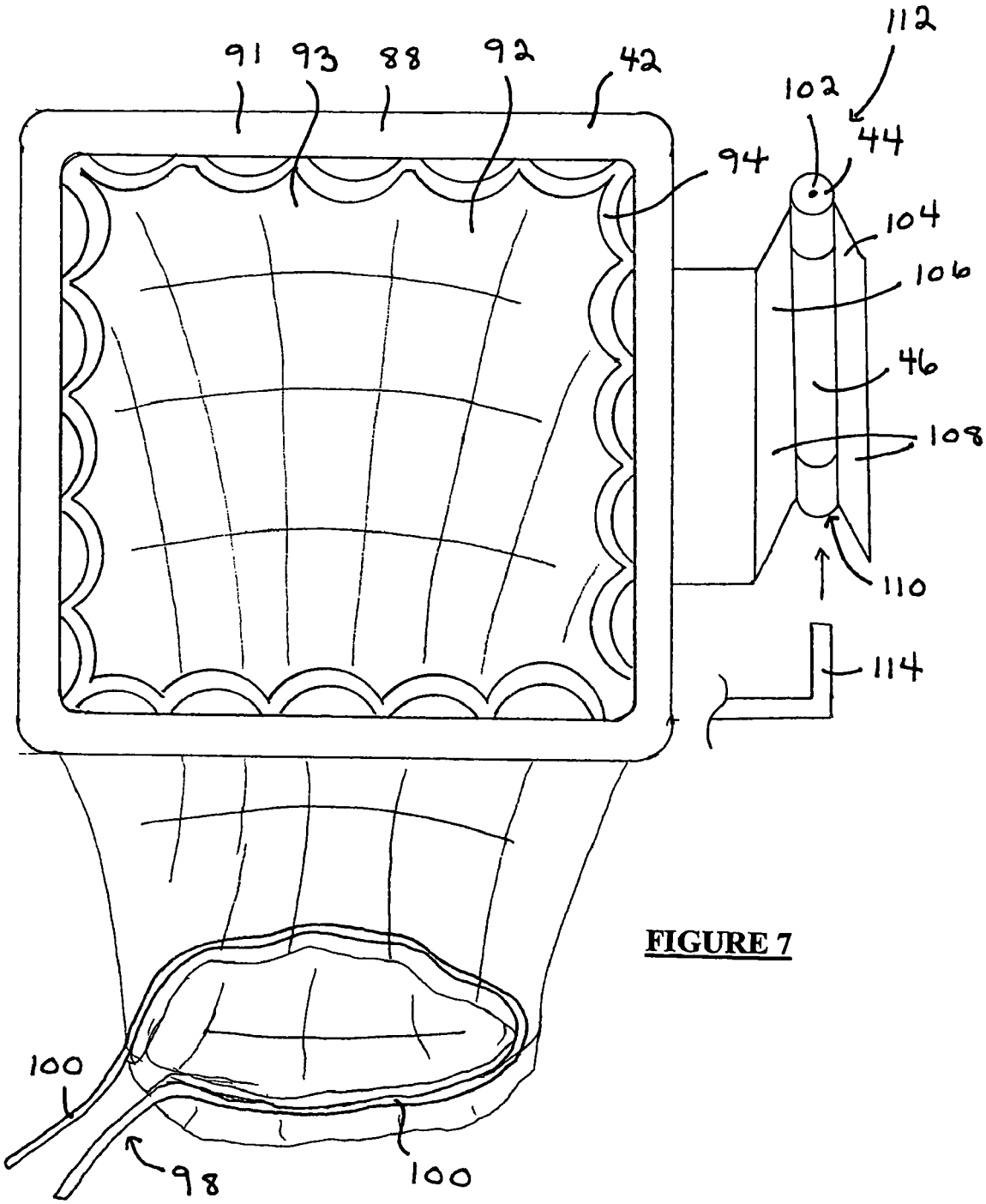
FIG. 7 is a front view of the mounting bracket and the target of the target apparatus shown in FIG. 3.

Referring to FIG. 7, the target (42) preferably includes a closing mechanism (98) for selectively closing the projectile receptacle (92) to permit the sport projectiles (22) to accumulate therein and for selectively opening the projectile receptacle (92) to permit the sport projectiles (22) to pass therethrough. Thus, the closing mechanism (98) is provided for selectively closing and opening the net (93). In the preferred embodiment, the closing mechanism (98) is comprised of a drawstring (100). The drawstring (100) is preferably comprised of a length of a ⅛ inch diameter nylon cord. Further, the drawstring (100) is associated with the net (93), and is located a spaced distance from the attachment of the net (93) with the corrugated steel round wire (94) such that a plurality of sport projectiles (22) may accumulate within the net (93). Accordingly, when the drawstring (100) is tightened, the projectile receptacle (92) is closed such that the sport projectiles (22) will accumulate therein. When the drawstring (100) is loosened, the projectile receptacle (92) is opened such that the sport projectiles (22) will be allowed to pass through the projectile receptacle (92).

Referring to FIGS. 3, 4, 7 and 9, the target hinge (44) is provided for connecting the mounting bracket (40) and the target (42), preferably such that the target (42) is located adjacent to the defensive area side (52) of the mounting bracket (40). Accordingly, the target (42) is positioned within the defensive area (30) of the sport goal (24) when the mounting bracket (40) is attached with the frame member (26). In addition, the target hinge (44) connects the target (42) with the mounting bracket (40) in a manner permitting the target (42) to rotate relative to the mounting bracket (40) between a forward target position and a deflected target position. Thus, depending upon the force of contact with the target (42) by a sport projectile (22) or a player, the target (42) may be caused to move towards the deflected target position.

Figure 3:
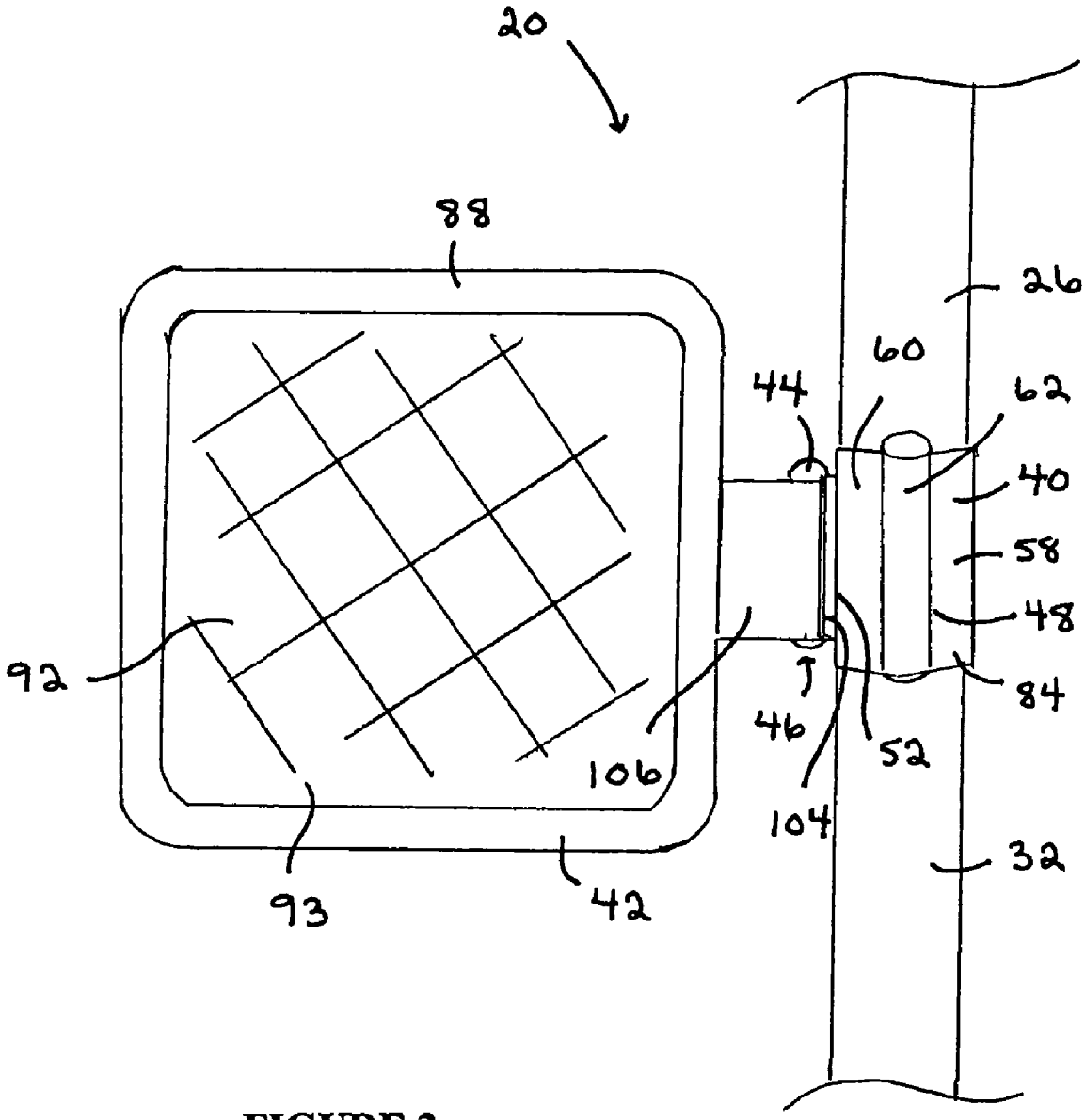
FIG. 3 is a front view of a frame member of the sport goal having the target apparatus attached thereto as shown in FIG. 1, wherein the target apparatus is in a forward target position.

In the forward target position as shown in FIG. 3, the target (42) is in a "ready" position for receiving the sport projectile (22). Thus, the front target plane (90) of the target (42) is preferably substantially perpendicular to the forward direction of the mounting bracket (40). The front target plane (90) of the target (42) need not be exactly perpendicular to the forward direction of the mounting bracket (40) so long as the front target plane (90) is substantially, about or approximately perpendicular. Accordingly, when the mounting bracket (40) is attached with the frame member (26), the front target plane (90) is substantially parallel with the front goal plane (28) of the sport goal (24). Similarly, the front target plane (90) need not be exactly parallel with the front goal plane (28) so long as the front target plane (90) is substantially, about or approximately parallel.

In the deflected target position, the front target plane (90) is angularly displaced in the rearward direction from the forward target position. Thus, the target (42) is deflected towards the back (50) of the mounting bracket (40). Accordingly, when the mounting bracket (40) is attached with the frame member (26), the target (42) is deflected in a rearward direction away from the front (38) of the sport goal (24) or the front goal plane (28) defined thereby. As a result, in the deflected target position, the front target plane (30) is not substantially perpendicular to the forward direction of the mounting bracket (40) and the front target plane (90) is not substantially parallel to the front goal plane (28) when the mounting bracket (40) is attached to the frame member (26).

Figure 4:
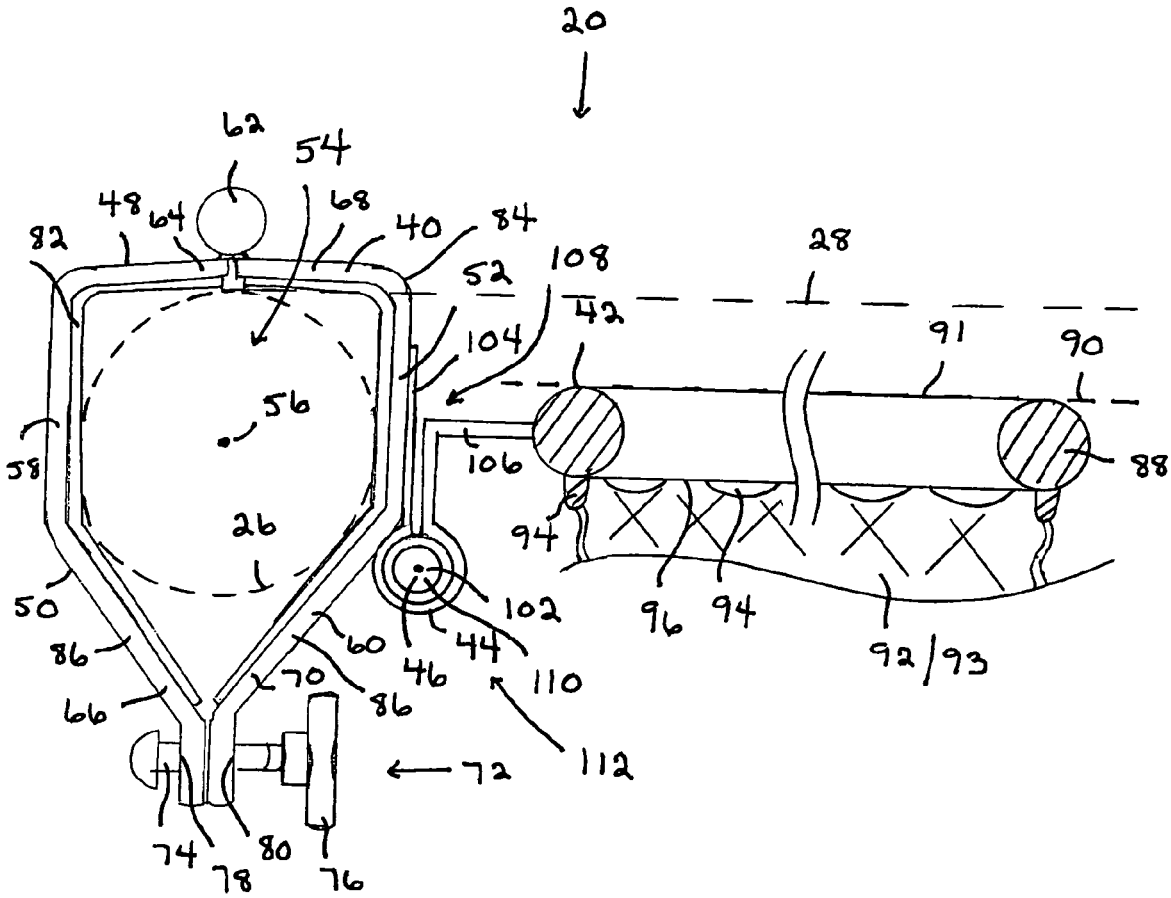
FIG. 4 is a top view of the target apparatus shown in FIG. 3, wherein a frame member of the sport goal is shown in dotted lines and wherein a target comprising the target apparatus is shown in cross-section, and showing a preferred positioning of a front target plane of the target apparatus.

Finally, referring to FIG. 4, the target hinge (44) preferably connects the target (42) with the mounting bracket (40) such that the front target plane (90) is rearward of the front (48) of the mounting bracket (40) when the target (42) is in the forward target position. More preferably, when the frame member (26) is received within the mounting bracket bore (54), the front target plane (90) is coincident with, or preferably rearward of, the front goal plane (28) of the sport goal (24) when the target (42) is in the forward target position. As a result, the target (42) is preferably positioned or located toward the net (36) of the sport goal (24) in a direction rearward of the front goal plane (28). As the target (42) is moved toward the deflected target position, the target (42) will move further rearward into the sport goal (24). Thus, in both the forward target position and the deflected target position, the target (42) is preferably substantially contained within the sport goal (24) or is substantially rearward of the front goal plane (28).

As shown in FIG. 4, in the preferred embodiment, the front target plane (90) is rearward of the front (48) of the mounting bracket (40) when the target (42) is in the forward target position. Further, the front target plane (90) preferably intersects with the mounting bracket bore (54) when the target (42) is in the forward target position. Thus, when the mounting bracket (40) is attached with the frame member (26) and the frame member (26) is received within the mounting bracket bore (54), the front target plane (90) intersects with the frame member (26).

Figure 4A:
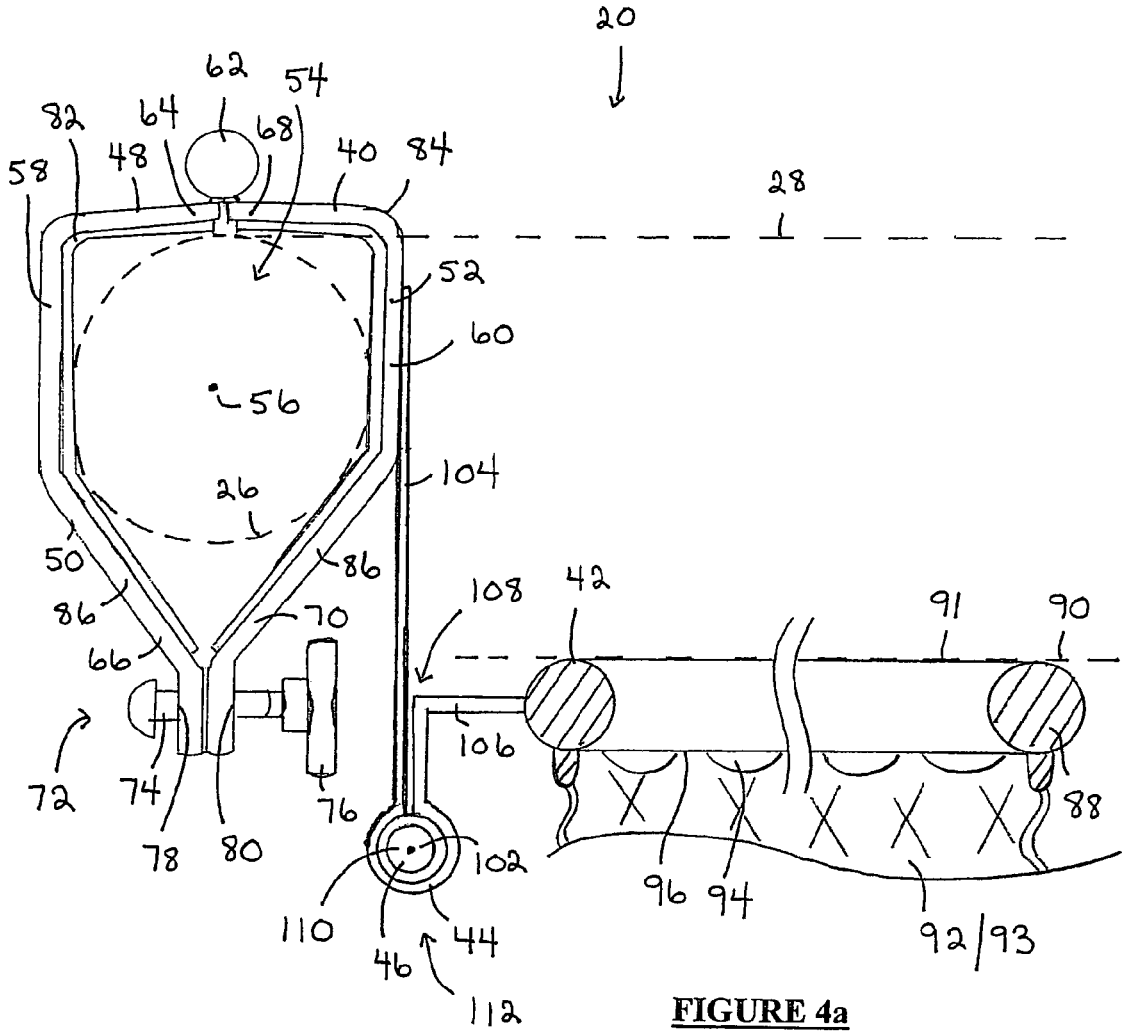
FIG. 4*a* is a further top view of the target apparatus shown in FIG. 4 showing an alternate positioning of the front target plane of the target apparatus.
Figure 5:
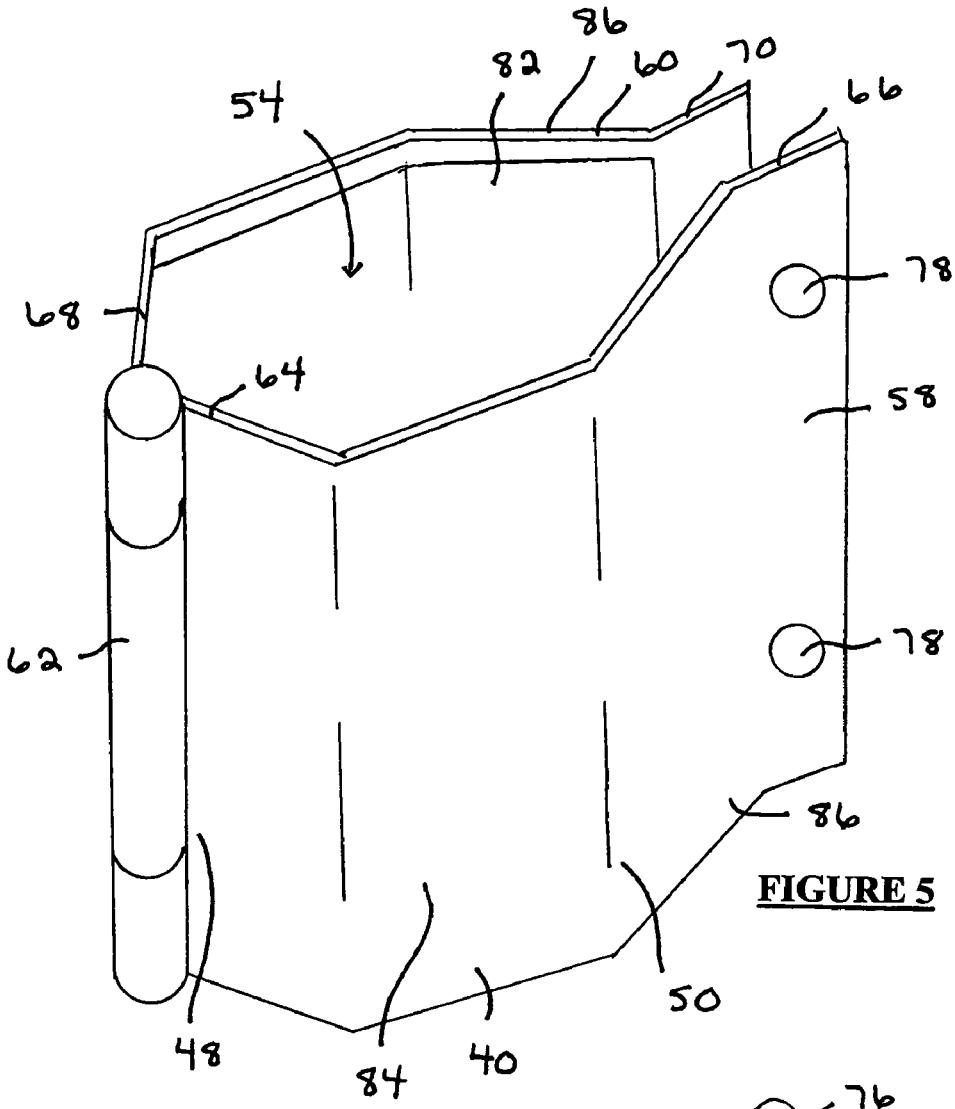
FIG. 5 is a pictorial view of a mounting bracket of the target apparatus shown in FIG. 3, in isolation.
Figure 6:
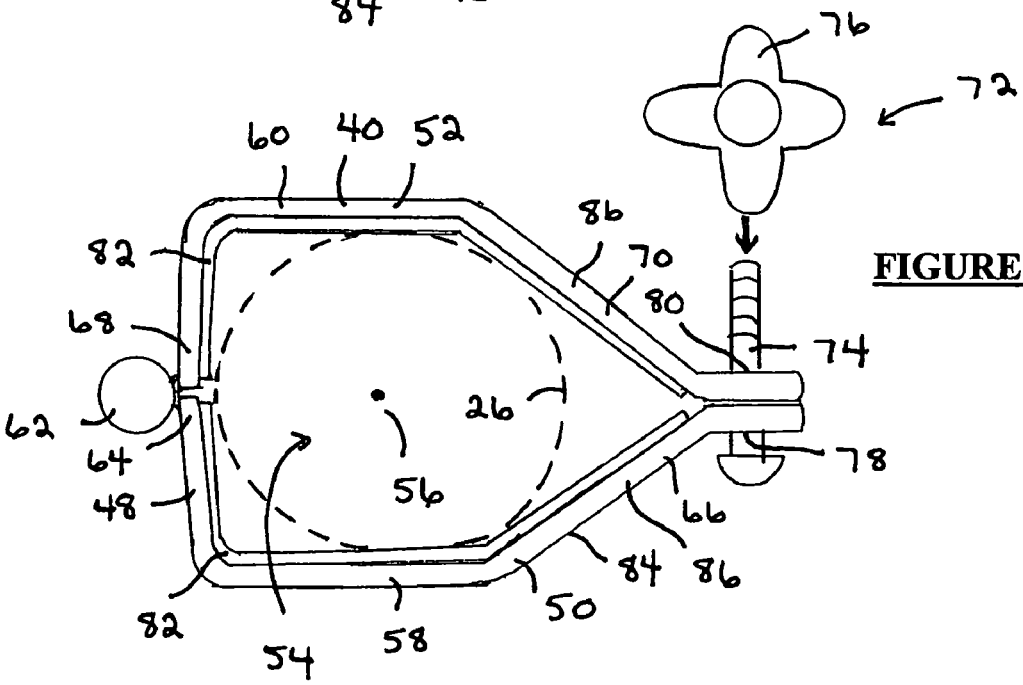
FIG. 6 is a top view of the mounting bracket of the target apparatus shown in FIG. 3, in isolation, wherein the frame member of the sport goal is shown in dotted lines.

However, alternately, as shown in FIG. 4*a*, the mounting bracket (40) and the target hinge (44) may be configured such that the front target plane (90) is positioned substantially rearward of the mounting bracket bore (54) when the target (42) is in the forward target position. Thus, when the mounting bracket (40) is attached with the frame member (26) and the frame member (26) is received within the mounting bracket bore (54), the front target plane (90) is substantially rearward of the frame member (26).

In each of these configurations, as a result of the placement or positioning of the front target plane (90) when the target (42) is in the forward target position, the likelihood of contact with the target (42) by a player during use of the target apparatus (20) is reduced.

The target hinge (44) is preferably fixedly connected between the target (42) and the mounting bracket (40) in any suitable manner. However, in the preferred embodiment, the target hinge (44) is welded with each of the target (42), preferably the target frame (88), and the mounting bracket (40) along the defensive area side (52). More particularly, the target hinge (44) preferably has a target hinge axis (102), which defines an axis of rotation of the target hinge (44). Further, the target hinge (44) is preferably comprised of a first plate member (104) extending from and rotatable about the target hinge axis (102) and a second plate member (104) extending from and rotatable about the target hinge axis (102).

In the preferred embodiment, the target hinge (44) is welded with the mounting bracket (40) such that the target hinge axis (102) is substantially parallel with the axis (56) of the mounting bracket bore (54). In addition, the target hinge axis (102) is preferably positioned nearer the back (50) of the mounting bracket (40) than the front (48) in order to facilitate the desired placement or positioning of the front target plane (90), as discussed above. In the preferred embodiment, the target hinge axis (102) is positioned adjacent the back (50) of the mounting bracket (40), preferably adjacent the dove-tailed portion (86), as shown in FIG. 4. In other words, the target hinge (44) preferably connects the target (42) with the mounting bracket (40) adjacent the back (50) of the mounting bracket (40). More preferably, the target hinge axis (102) is located about 1-2 inches from the most forward portion of the mounting bracket bore (54) adjacent the front (48) of the mounting bracket (40). However, the specific offset or distance from the front (48) of the mounting bracket (40) may vary depending upon, amongst other factors, the specific configuration of the other components of the target apparatus (20).

Thus, the first plate member (104) is preferably welded to the mounting bracket (40) along the defensive area side (52) at a location such that the target hinge axis (102) is preferably positioned adjacent or towards the back (50) of the mounting bracket (40). The second plate member (106) is welded to an adjacent side surface of the target frame (88) between the forward and rear surfaces (91, 96). Preferably, the second plate member (106) is configured to permit the target hinge axis (102) to be located or positioned behind or rearward of the front target plane (90). Thus, when the target (42) is in the forward target position, the target hinge (42) is substantially contained or positioned rearward of or behind the target frame (88). Accordingly, the target hinge (44) is not exposed to or readily accessible by a player outside of the sport goal (24) when in the forward target position. As a result, the likelihood of a player having contact with, or being injury by, the target hinge (42) is reduced.

In addition, the target apparatus (20) preferably includes a stop mechanism (108) for preventing the rotation of the target (42) relative to the mounting bracket (40) such that the front target plane (90) is angularly displaced in the forward direction from the forward target position. When the mounting bracket (40) is attached with the frame member (26), it is desirable for safety reasons to prevent or substantially restrain the deflection of the target (42) out of the sport goal (24) or in a direction forward of the front goal plane (28). Thus, rotation of the target (42) relative to the mounting bracket (40) in a direction forward of the forward target position is substantially restrained or inhibited by the stop mechanism (108). In the preferred embodiment, the stop mechanism (108) is comprised of the first and second plate members (104, 106) of the target hinge (44). In particular, each of the first and second plate members (104, 106) is configured such that as the target (42) rotates to the front target position about the target hinge axis (102), the first and second plate members (104, 106) abut against or engage each other to prevent any further movement in the forward direction, as shown in FIG. 4.

The biasing mechanism (46) is provided for urging the target (42) to rotate relative to the mounting bracket (40) toward the forward target position. Thus, the biasing mechanism (46) provides a biasing force which is sufficient to cause the target (42) to be returned to the forward target position from the deflected target position. Further, the biasing mechanism (46) is preferably comprised of a biasing adjustment mechanism (110) for adjusting the biasing force provided by the biasing mechanism (46). Preferably, the biasing mechanism (46) is comprised of a spring and the biasing adjustment mechanism (110) is comprised of a spring tightening mechanism which permits the adjustment of a spring force provided by the spring, wherein the spring force is the force required to deflect the spring.

Figure 9:
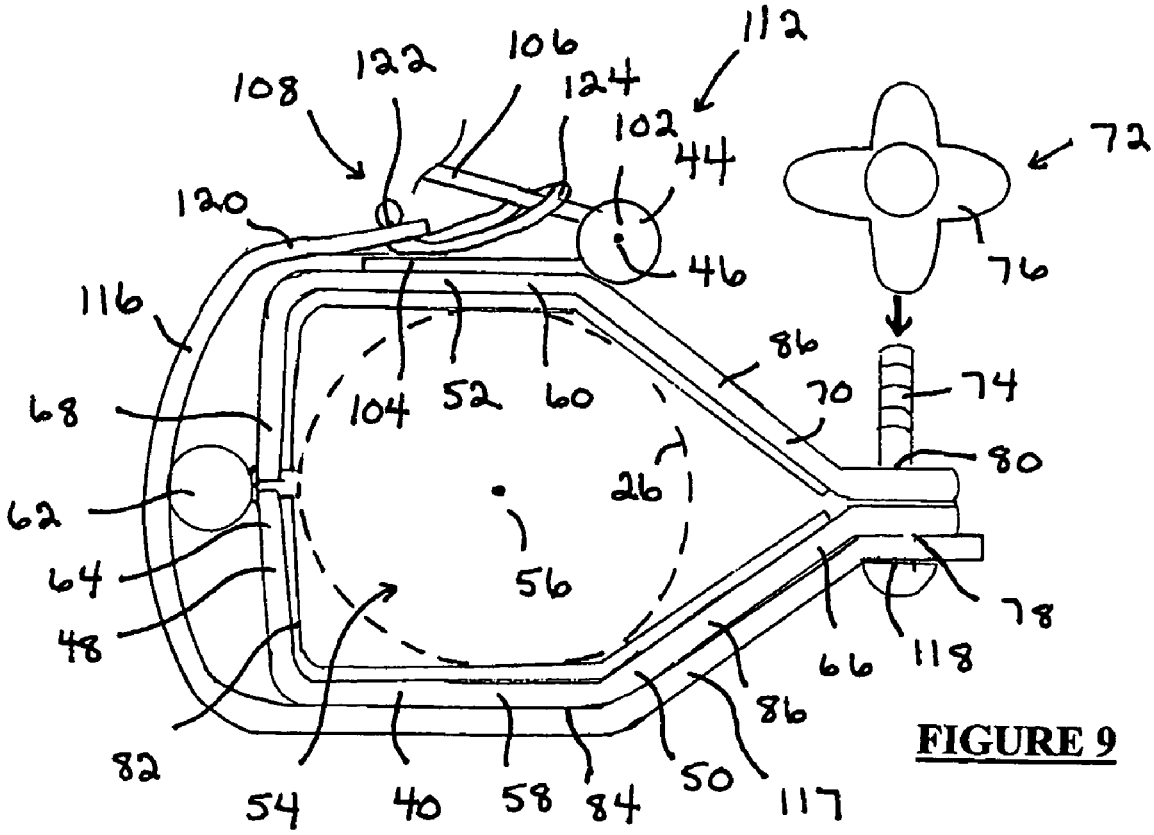
FIG. 9 is a top view of the mounting bracket of the target apparatus as shown in FIG. 6 having the cushion pad of FIG. 8 attached thereto.

Referring to FIGS. 4, 7 and 9, in the preferred embodiment, the target hinge (44) is comprised of the biasing mechanism (46) and the biasing adjustment mechanism (110). In particular, the target hinge (46) is comprised of an adjustable spring hinge (112) which includes the spring and compatible spring tightening mechanism. Any conventional or known adjustable spring hinge (112) may be used, which adjustable spring hinge (112) may also be referred to in the industry as an adjustable "self-closing" spring hinge, an adjustable spring loaded hinge, a retracting adjustable hinge or a spring hinge having an adjustable spring force or tension.

The adjustable spring hinge (112) may be adjusted to a desired spring force, and maintained at the desired spring force, using any suitable mechanism or adjustable structure. For instance, the adjustable spring hinge (112) may include a corresponding pin and slot structure to maintain the spring tightening mechanism at a desired position providing the desired spring force. However, preferably, the adjustable spring hinge (112) includes an internal ratchet mechanism for maintaining the spring tightening mechanism at a desired position.

In the preferred embodiment, the adjustable spring hinge (112) includes a ratchet adjustable coil spring. Further, the adjustable spring hinge (112) typically includes an Allen or hex screw which acts upon the coil spring to adjust the spring force and which is maintained at a desired tension or spring force by an internal ratchet mechanism. Further, the spring force is adjusted through the use of a compatible Allen or hex wrench or key (114) which is used to turn or rotate the Allen screw in a desired direction to either "tighten" or "loosen" the Allen screw acting upon the coil spring. In the preferred embodiment, the target hinge (44) is comprised of a STANLEY™ spring hinge having an adjustable tension or spring force, preferably a STANLEY™ 2060R Series Spring Hinge. STANLEY™ is a trade-mark of The Stanley Works, a U.S. corporation.

In use, the spring force is adjusted such that it is suitable for the specific intended use of the target apparatus (20) at any given time and such that control of the movement of the target (42) is maintained at all times. In particular, the spring force preferably maintains the target (42) in the forward target position, while permitting its movement toward the deflected target position upon contact with the target (42). In this regard, the spring force will be selected to reduce, and preferably minimize, any likelihood of injury to a player upon contact with the target (42), while resisting deflection upon minimal or minor contact with the target (42). In addition, the spring force is selected to readily return the target (42) to the forward target position in a controlled manner when deflected such that the target (42) is maintained in a "ready" forward target position during the practice session.

Finally, the spring force of the adjustable spring hinge (112) may be adjusted to achieve the above goals or functions in a manner which is also compatible with, and suitable for, the size, skill and experience level of the particular players intending to use the target apparatus (20). For instance, a greater or higher spring force may be desirable for larger/older players or those having a higher skill or experience level, while a lesser or lower biasing force may be desirable for smaller/younger players or those having a lower skill or experience level.

Figure 8:
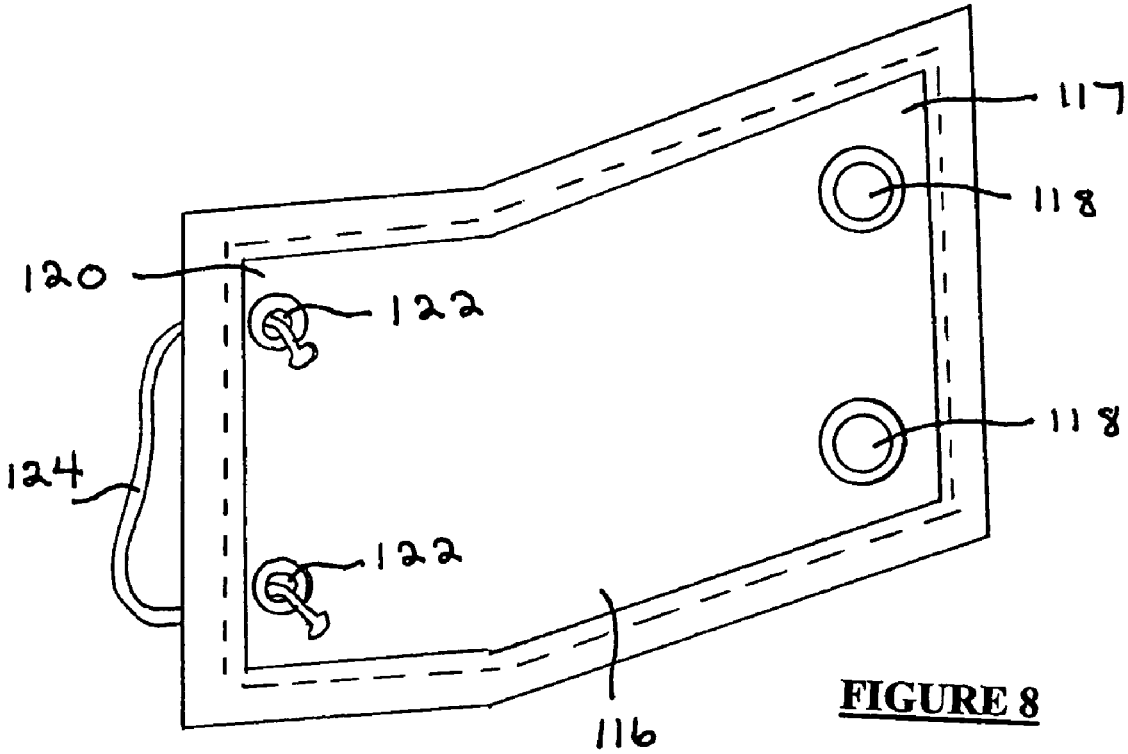
FIG. 8 is a front view of a removable cushion pad for the target apparatus shown in FIG. 3.

Finally, referring to FIGS. 8 and 9, the target apparatus (20) is preferably further comprised of a removable cushion pad (116) for substantially surrounding the front (48) of the mounting bracket (40) or that portion of the mounting bracket (40) facing in the forward direction towards an oncoming player or towards the goaltender during use of the target apparatus (20). The removable cushion pad (116) provides cushioning or padding for the mounting bracket (40) in the event of any impact therewith by a player. In the preferred embodiment, the cushion pad (116) is comprised of a vinyl covering with an inner felt padding. The vinyl covering provides a relatively durable, tear-resistant, water repellant covering material for the inner felt pad. In the preferred embodiment, the vinyl covering is comprised of two portions or patches of 8000 lbs. vinyl material which are stitched or otherwise affixed together to form the complete outer covering. An inner felt pad having a thickness sufficient to provide a desired padding or cushioning effect is stitched between the vinyl covering patches such that it is enclosed thereby. Preferably, the inner felt pad has a thickness of about ½ inches.

In the preferred embodiment, the cushion pad (116) is removably attached about the mounting bracket (40) through use of the releasable fastener mechanism (72) comprising the mounting bracket (40). In particular, a first side (117) of the cushion pad (116) preferably defines a pair of holes (118) corresponding with the holes (78, 80) at the second ends (66, 70) of the first and second mounting bracket components (58, 60). Preferably, each of the holes (118) is comprised of a grommet for preventing tearing of the cushion pad (116).

Thus, when attaching the mounting bracket (40) to the frame member (26) of the sport goal (24), a threaded fastener (74) is passed through each of the holes (118) in the first side (117) of the cushion pad (116) concurrently with the passage of the threaded fastener (74) through the corresponding holes (78, 80) in the mounting bracket components (58, 60). As a result, the attachment of the wing nut (76) to the end of the threaded fastener (74) securely closes the mounting bracket (40) and further secures the first side (117) of the cushion pad (116) with the second ends (66, 70) of the first and second mounting bracket components (58, 60).

The cushion pad (116) is then wrapped around the mounting bracket (40) and secured or maintained across the front (48) thereof. In particular, an opposed second side (120) of the cushion pad (116) is secured to the target apparatus (20) to maintain the cushion pad (116) in the desired position. In the preferred embodiment, the opposed second side (120) of the cushion pad (116) also defines a pair of spaced apart holes (122). Preferably, each of these holes (122) is also comprised of a grommet for preventing tearing of the cushion pad (116). Finally, opposed ends of an elastic retention cord (124) are secured in the holes (122) at the second end (120) of the cushion pad (116) such that the elastic retention cord (124) extends therebetween. When attaching the mounting bracket (40) to the frame member (26), the elastic retention cord (124) is positioned about the back or rearward portion of the target hinge (44), and preferably about the second plate member (106) of the target hinge (44), such that the second side (120) of the cushion pad (116) is secured with the target hinge (44). The elastic nature of the retention cord (124) maintains the second side (120) of the cushion pad (116) in position while permitting the rotation of the target (42) relative to the mounting bracket (40).

The embodiments of the invention in which an exclusive property or privilege is claimed are defined as follows:

1. A target apparatus for use with a sport goal, the sport goal comprising a plurality of frame members, the frame members defining a front goal plane and a defensive area within the front goal plane, the apparatus comprising:

(a) a mounting bracket comprising a front, an opposed back and a defensive area side, the mounting bracket being adapted to be releasably attached to one of the plurality of frame members such that the front of the mounting bracket faces a forward direction substantially perpendicular to the front goal plane, such that the back of the mounting bracket faces an opposed rearward direction and such that the defensive area side is adjacent to the defensive area;

(b) a target for a sport projectile, the target defining a front target plane and a projectile receptacle rearward of the front target plane, wherein the projectile receptacle is configured to receive a plurality of sport projectiles therein, further comprising a closing mechanism for selectively closing the projectile receptacle to permit the sport projectiles to accumulate in the projectile receptacle and for selectively opening the projectile receptacle to permit the sport projectiles to pass through the projectile receptacle without accumulating in the projectile receptacle;

(c) a target hinge connecting the mounting bracket and the target such that the target is located adjacent to the defensive area side of the mounting bracket, such that the target is rotatable relative to the mounting bracket between a forward target position for receiving the sport projectile in which the front target plane is substantially perpendicular to the forward direction of the mounting bracket and a deflected target position in which the front target plane is angularly displaced in the rearward direction from the forward target position, and such that the front target plane is rearward of the front of the mounting bracket when the target is in the forward target position; and (d) a biasing mechanism associated with the target hinge for urging the target to rotate relative to the mounting bracket toward the forward target position.

2. The apparatus as claimed in claim 1 wherein the biasing mechanism is comprised of a biasing adjustment mechanism for adjusting a biasing force provided by the biasing mechanism.

3. The apparatus as claimed in claim 2 wherein the biasing mechanism is comprised of a spring.

4. The apparatus as claimed in claim 3 wherein the biasing adjustment mechanism is comprised of a spring tightening mechanism.

5. The apparatus as claimed in claim 1 wherein the projectile receptacle is comprised of a net.

6. The apparatus as claimed in claim 1 wherein the closing mechanism is comprised of a drawstring.

7. A target apparatus for use with a sport goal, the sport goal comprising a plurality of frame members, the frame members defining a front goal plane and a defensive area within the front goal plane, the apparatus comprising:

(a) a mounting bracket comprising a front, an opposed back and a defensive area side, the mounting bracket being adapted to be releasably attached to one of the plurality of frame members such that the front of the mounting bracket faces a forward direction substantially perpendicular to the front goal plane, such that the back of the mounting bracket faces an opposed rearward direction and such that the defensive area side is adjacent to the defensive area, and wherein the mounting bracket is further comprised of a first mounting bracket component, a second mounting bracket component, and a mounting bracket hinge for connecting the first mounting bracket component and the second mounting bracket component;

(b) a target for a sport projectile, the target defining a front target plane and a projectile receptacle rearward of the front target plane;

(c) a target hinge connecting the mounting bracket and the target such that the target is located adjacent to the defensive area side of the mounting bracket, such that the target is rotatable relative to the mounting bracket between a forward target position for receiving the sport projectile in which the front target plane is substantially perpendicular to the forward direction of the mounting bracket and a deflected target position in which the front target plane is angularly displaced in the rearward direction from the forward target position, and such that the front target plane is rearward of the front of the mounting bracket when the target is in the forward target position; and (d) a biasing mechanism associated with the target hinge for urging the target to rotate relative to the mounting bracket toward the forward target position.

8. The apparatus as claimed in claim 7 wherein the biasing mechanism is comprised of a biasing adjustment mechanism for adjusting a biasing force provided by the biasing mechanism.

9. The apparatus as claimed in claim 8 wherein the biasing mechanism is comprised of a spring.

10. The apparatus as claimed in claim 9 wherein the biasing adjustment mechanism is comprised of a spring tightening mechanism.

11. The apparatus as claimed in claim 7 wherein the mounting bracket defines a mounting bracket bore for receiving the frame member, wherein the mounting bracket bore has a mounting bracket bore axis, wherein the target hinge has a target hinge axis and wherein the target hinge axis is substantially parallel with the mounting bracket bore axis.

12. The apparatus as claimed in claim 7 wherein the mounting bracket defines a mounting bracket bore for receiving the frame member and wherein the front target plane intersects with the mounting bracket bore when the target is in the forward target position.

13. The apparatus as claimed in claim 7 wherein the target hinge connects the target with the mounting bracket adjacent the back of the mounting bracket.

14. The apparatus as claimed in claim 7, further comprising a removable cushion pad for substantially surrounding the front of the mounting bracket.

15. The apparatus as claimed in claim 7 wherein the first mounting bracket component is comprised of a first end and a second end, wherein the second mounting bracket component is comprised of a first end and a second end, wherein the mounting bracket hinge connects the first end of the first mounting bracket component with the first end of the second mounting bracket component, and wherein the mounting bracket is further comprised of a releasable fastener mechanism for releasably connecting the second end of the first mounting bracket component with the second end of the second mounting bracket component.

16. The apparatus as claimed in claim 15 wherein the releasable fastener mechanism is comprised of at least one threaded fastener, wherein the first mounting bracket component defines a hole adjacent the second end for accepting the threaded fastener and wherein the second mounting bracket component defines a hole adjacent the second end for accepting the threaded fastener.

17. The apparatus as claimed in claim 16 wherein the releasable fastener mechanism is further comprised of a wing nut for attachment to the threaded fastener.

18. The apparatus as claimed in claim 15 wherein the mounting bracket hinge is located at the front of the mounting bracket.

19. The apparatus as claimed in claim 18 wherein the releasable fastener mechanism is located at the back of the mounting bracket.

20. The apparatus as claimed in claim 7 wherein the mounting bracket defines a mounting bracket bore for receiving the frame member and further comprising a resilient material lining at least a portion of the mounting bracket bore, for inhibiting relative movement between the mounting bracket and the frame member.

21. The apparatus as claimed in claim 7 wherein the apparatus is configured such that the front target plane is substantially parallel to the front goal plane when the mounting bracket is attached to the frame member and the target is in the forward target position.

22. The apparatus as claimed in claim 21 wherein the apparatus is configured such that the front target plane is rearward of the front goal plane when the mounting bracket is attached to the frame member and the target is in the forward target position.

23. A target apparatus for use with a sport goal, the sport goal comprising a plurality of frame members, the frame members defining a front goal plane and a defensive area within the front goal plane, the apparatus comprising:

(a) a mounting bracket comprising a front, an opposed back and a defensive area side, the mounting bracket being adapted to be releasably attached to one of the plurality of frame members such that the front of the mounting bracket faces a forward direction substantially perpendicular to the front goal plane, such that the back of the mounting bracket faces an opposed rearward direction and such that the defensive area side is adjacent to the defensive area;

(b) a target for a sport projectile, the target defining a front target plane and a projectile receptacle rearward of the front target plane;

(c) a target hinge connecting the mounting bracket and the target such that the target is located adjacent to the defensive area side of the mounting bracket, such that the target is rotatable relative to the mounting bracket between a forward target position for receiving the sport projectile in which the front target plane is substantially perpendicular to the forward direction of the mounting bracket and a deflected target position in which the front target plane is angularly displaced in the rearward direction from the forward target position, and such that the front target plane is rearward of the front of the mounting bracket when the target is in the forward target position;

(d) a biasing mechanism associated with the target hinge for urging the target to rotate relative to the mounting bracket toward the forward target position; and (e) a stop mechanism for preventing the rotation of the target relative to the mounting bracket such that the front target plane is angularly displaced in the forward direction from the forward target position.

24. The apparatus as claimed in claim 23 wherein the biasing mechanism is comprised of a biasing adjustment mechanism for adjusting a biasing force provided by the biasing mechanism.

25. The apparatus as claimed in claim 24 wherein the biasing mechanism is comprised of a spring.

26. The apparatus as claimed in claim 25 wherein the biasing adjustment mechanism is comprised of a spring tightening mechanism.

27. A target apparatus for use with a sport goal, the sport goal comprising a plurality of frame members, the frame members defining a front goal plane and a defensive area within the front goal plane, the apparatus comprising:

(a) a mounting bracket comprising a front, an opposed back and a defensive area side, the mounting bracket being adapted to be releasably attached to one of the plurality of frame members such that the front of the mounting bracket faces a forward direction substantially perpendicular to the front goal plane, such that the back of the mounting bracket faces an opposed rearward direction and such that the defensive area side is adjacent to the defensive area, wherein the mounting bracket defines a mounting bracket bore for receiving the frame member and wherein the front target plane is substantially rearward of the mounting bracket bore when the target is in the forward target position;

(b) a target for a sport projectile, the target defining a front target plane and a projectile receptacle rearward of the front target plane;

(c) a target hinge connecting the mounting bracket and the target such that the target is located adjacent to the defensive area side of the mounting bracket, such that the target is rotatable relative to the mounting bracket between a forward target position for receiving the sport projectile in which the front target plane is substantially perpendicular to the forward direction of the mounting bracket and a deflected target position in which the front target plane is angularly displaced in the rearward direction from the forward target position, and such that the front target plane is rearward of the front of the mounting bracket when the target is in the forward target position; and (d) a biasing mechanism associated with the target hinge for urging the target to rotate relative to the mounting bracket toward the forward target position.

28. The apparatus as claimed in claim 27 wherein the biasing mechanism is comprised of a biasing adjustment mechanism for adjusting a biasing force provided by the biasing mechanism.

29. The apparatus as claimed in claim 28 wherein the biasing mechanism is comprised of a spring.

30. The apparatus as claimed in claim 29 wherein the biasing adjustment mechanism is comprised of a spring tightening mechanism.

* * * * *